US005309958A

United States Patent [19]

Ueda et al.

[11] Patent Number: 5,309,958

[45] Date of Patent: May 10, 1994

[54] FILLING APPARATUS FOR VISCOUS FOODS

[75] Inventors: Michio Ueda; Takahiro Sawabuchi; Masakatsu Kondo, all of Tokushima, Japan

[73] Assignee: Shikoku Kakoki Co., Ltd., Itano, Japan

[21] Appl. No.: 964,013

[22] Filed: Oct. 21, 1992

[30] Foreign Application Priority Data

Oct. 23, 1991 [JP] Japan ..... 3-086552[U]

[51] Int. Cl.[5] ..... B65B 3/04; B65B 3/12; B65B 3/14; B67C 3/02

[52] U.S. Cl. ..... 141/90; 99/485; 99/516; 137/244; 141/392; 222/148; 222/380; 239/112

[58] Field of Search ..... 99/450.1, 452, 460, 99/516, 534, 485, 353; 222/148, 380; 239/112; 141/1, 85, 87, 89, 90, 392; 118/24, 25, 52, 302; 137/244; 53/86

[56] References Cited

U.S. PATENT DOCUMENTS

| | | | |
|---|---|---|---|
| 3,127,071 | 3/1964 | Bingham | 222/380 |
| 3,498,508 | 3/1970 | Francisoud et al. . | |
| 3,658,083 | 4/1972 | Fetterolf et al. | 137/244 |
| 3,926,229 | 12/1975 | Scholle | 141/90 |
| 4,081,006 | 3/1978 | Crowell et al. | 222/148 |
| 4,235,265 | 11/1980 | Feliks | 222/380 |
| 4,457,348 | 7/1984 | Mueller et al. | 141/1 |
| 4,460,025 | 7/1984 | Scholle et al. | 141/90 |
| 4,542,710 | 9/1985 | Nakayama | 118/52 |
| 4,867,345 | 9/1989 | Nakayama | 118/302 |
| 5,099,895 | 3/1992 | Loeliger | 141/89 |
| 5,171,367 | 12/1992 | Fitch, Jr. | 222/380 |

FOREIGN PATENT DOCUMENTS

| | | | |
|---|---|---|---|
| 0104394 | 4/1984 | European Pat. Off. | 239/112 |
| 52-22600 | 6/1977 | Japan . | |
| 2081235 | 2/1982 | United Kingdom | 141/90 |

OTHER PUBLICATIONS

Abstract 92203229.7 A filling apparatus for viscous foods; pub. Dec. 16, 1975.

*Primary Examiner*—Timothy F. Simone
*Attorney, Agent, or Firm*—Armstrong, Westerman, Hattori, McLeland & Naughton

[57] ABSTRACT

A filling apparatus for viscous foods comprising a vertical tubular filling nozzle having a flow inlet formed in a tubular wall close to the lower end thereof and a piston-incorporating metering cylinder in communication with the flow inlet, and a plunger accommodated in the filling nozzle so as to open or close the flow inlet. The plunger has an air discharge annular opening defined by a lower-end peripheral portion thereof for blowing off adhering food and a recess formed inside the air discharge opening and providing an air reservoir for preventing adhesion of the food.

6 Claims, 4 Drawing Sheets

FILLING APPARATUS FOR VISCOUS FOODS

BACKGROUND OF THE INVENTION

The present invention relates to a filling apparatus for thick or viscous foods containing a solid ingredient, such as curry roux containing vegetables and meat.

Examined Japanese Patent Publication No. 2600/1977 discloses an apparatus of the type mentioned already known, which comprises a vertical tubular filling nozzle having a flow inlet formed in its tubular wall close to the lower end thereof and a piston-incorporating metering cylinder in communication with the flow inlet, and a plunger accommodated in the filling nozzle so as to open or close the flow inlet. The plunger has a multiplicity of air discharge openings formed in its lower end face and positioned dispersely over the entire area of the end face for blowing off adhered food.

With the conventional apparatus described, food adheres to the lower end face of the plunger over the entire area thereof. Although portions of the adhering food close to the respective air discharge openings are blown off with the air forced out from the openings, the other portion of the food remote from the openings will not always be blown off. Notwithstanding that a large quantity of food is unlikely to adhere to the lower end face of the plunger, the food will then remain unremoved although in a small amount. Since the amount of remaining food is likely to vary from one filling cycle to another, it is difficult to fill the food in a specified amount accurately.

SUMMARY OF THE INVENTION

The main object of the present invention is to provide an apparatus adapted to fill a viscous food accurately in a predetermined amount.

The filling apparatus of the present invention for viscous foods comprises a vertical tubular filling nozzle having a flow inlet formed in a tubular wall close to the lower end thereof and a piston-incorporating metering cylinder in communication with the flow inlet, and a plunger accommodated in the filling nozzle so as to open or close the flow inlet, the plunger having an air discharge annular opening defined by a lower-end peripheral portion thereof for blowing off adhering food and a recess formed inside the air discharge opening and providing an air reservoir for preventing adhesion of the food.

With the viscous food filling apparatus of the invention, the plunger has an air discharge annular opening defined by the lower-end peripheral portion thereof for blowing off adhering food and a recess formed inside the air discharge opening and providing an air reservoir for preventing adhesion of food. Accordingly, when air is retained in the reservoir beneath the lower end face of the plunger centrally thereof, no food adheres to the central portion of lower end face of the plunger, but the food adheres locally only to the outer side of the recessed portion, whereas the adhering food is blown off with air forced out from the discharge opening. Consequently, little or no food adheres to the lower end face of the plunger, making it possible to fill the food in a predetermined amount accurately.

DESCRIPTION OF THE PREFERRED EMBODIMENTS

Figure 1:
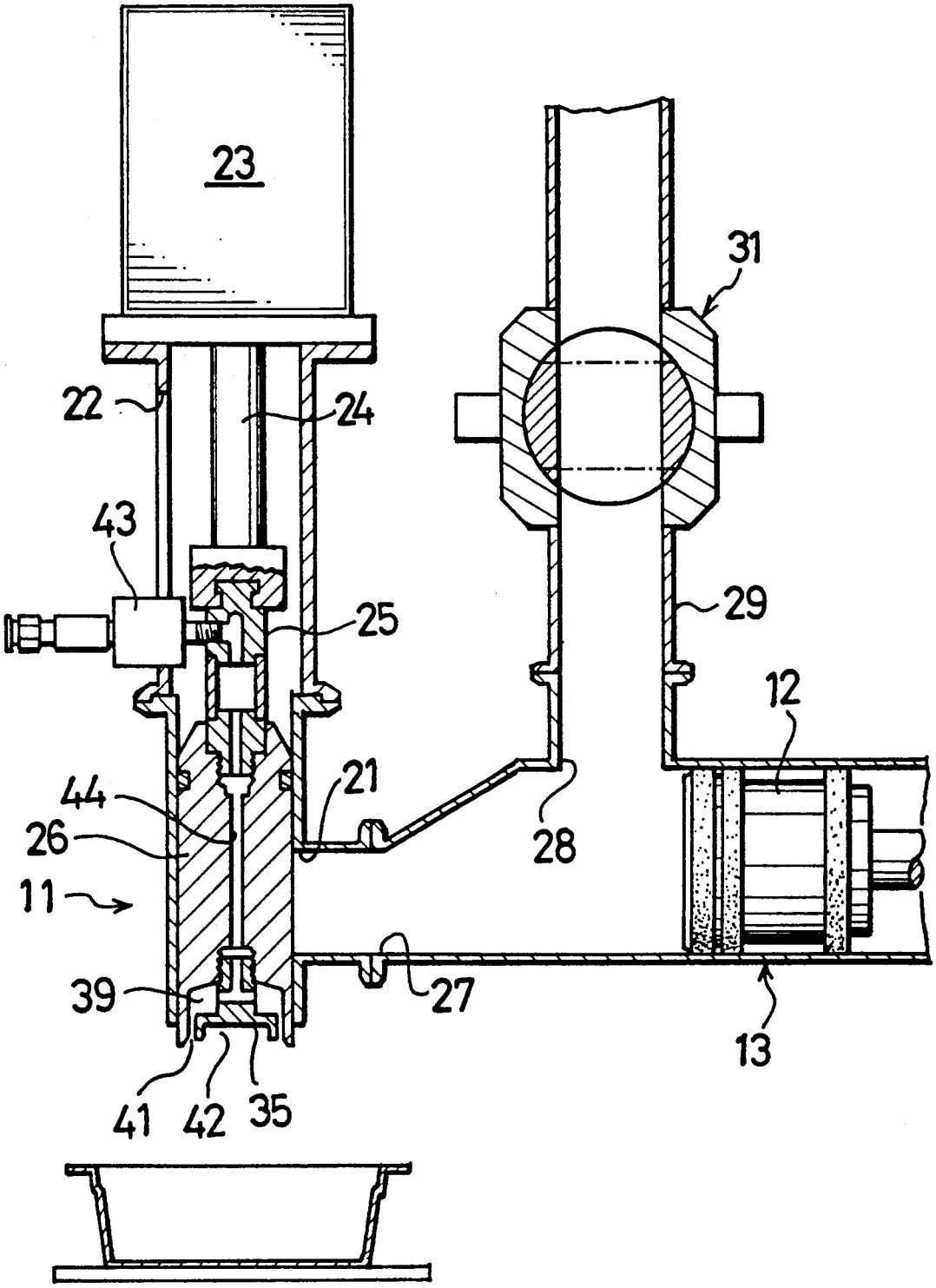
FIG. 1 is a view in vertical longitudinal section of an apparatus embodying the invention.
Figure 2:
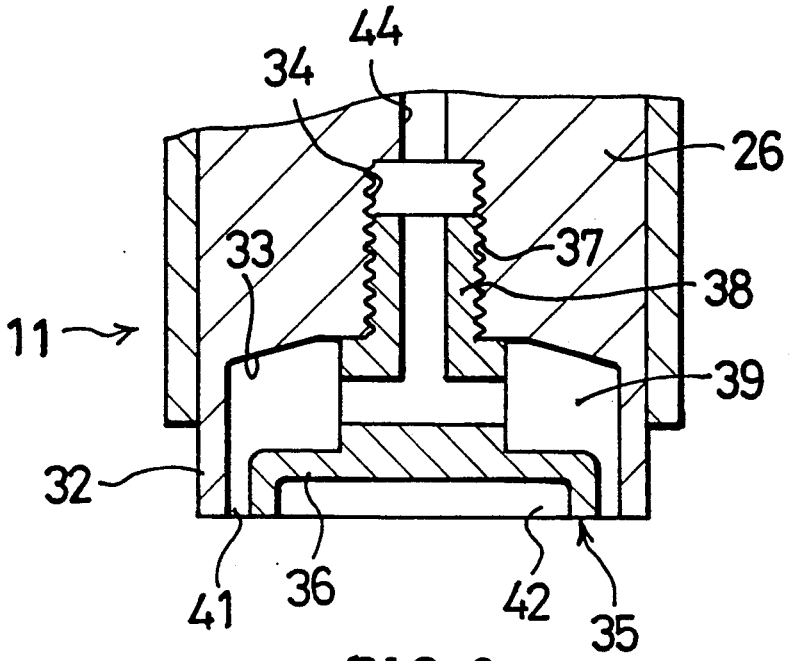
FIG. 2 is a fragmentary sectional view of FIG. 1.
Figure 3:
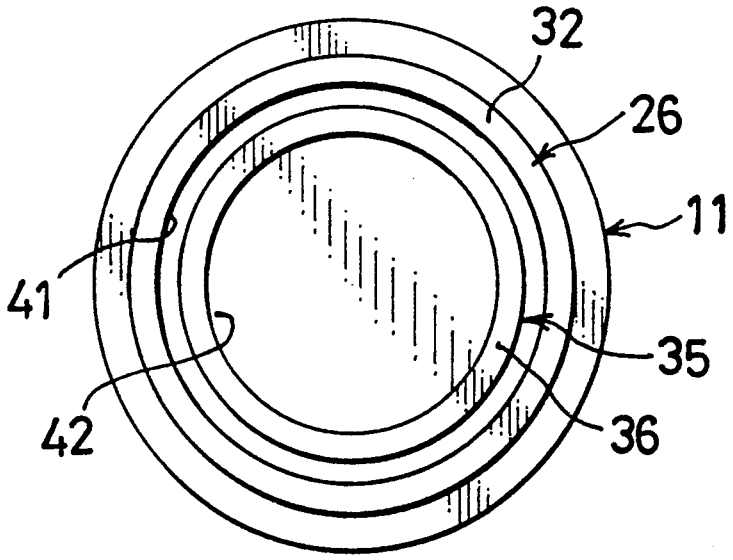
FIG. 3 is a bottom view of FIG. 2.

Embodiments of the invention will be described below with reference to the drawings.

The illustrated filling apparatus comprises a vertical tubular filling nozzle 11 disposed above a path of transport of containers, and a metering cylinder 13 having a piston 12 housed therein for feeding the liquid to be filled to the filling nozzle 11 in a specified amount at a time by the operation of the piston 12.

The filling nozzle 11 has a rightward flow inlet 21 formed in its peripheral wall close to the lower end thereof, and a leftward pipe insertion hole 22 formed in an upper portion of the peripheral wall. Mounted on the upper end of the filling nozzle 11 is a fluid pressure cylinder 23 having a piston rod 24 directed downward to cause the piston rod to advance into the cylinder 11. A plunger 26 is attached to the piston rod 24 by a connecting member 25. The metering cylinder 13 has an outlet 27 in communication with the flow inlet 21, and an inlet 28. A supply pipe 29 extending from an unillustrated tank is joined to the cylinder 13 in communication with the inlet 28. The supply pipe 29 is provided with an opening-closing change-over cock 31.

The lower end face of the plunger 26 is formed with a cavity 33 in its central portion to provide a skirt 32 at the peripheral portion of the lower end. A threaded bore 34 is formed in the central portion of the plunger end in communication with the top of the cavity 33. A food adhesion preventing member 35 is accommodated in the cavity 33. The preventing member 35 comprises a horizontal disk portion 36 spaced apart from the top and periphery of the cavity-defining surface of the plunger 26, and a vertical cylinder portion 38 extending upright from the top side of the disk portion 36 centrally thereof. The cylinder portion is externally threaded as at 37 and screwed in the threaded bore 34. The space within the cavity 33 above the disk portion 36 serves as a pressurized air chamber 39, and the clearance in the cavity around the disk portion 36 provides an air discharge opening 41. A recess 42 is further formed in the lower surface of the disk portion 36 to provide an air reservoir for preventing adhesion of food.

On the other hand, a union 43 connected to unillustrated pressurized air piping is screwed in the connecting member 25. A pressurized air channel 44 extends from the union 43 to the air chamber 39 through the connecting member 25, the plunger 26 and the preventing member 35.

With reference to FIG. 1, the plunger 26 is in the lower limit position of its vertical stroke, and the flow inlet 21 is held closed by the plunger 26. The piston 12 is in the left limit position of its horizontal stroke, with the cock 31 left open. When the piston 12 moves from the left limit position to the right limit position in this state, a predetermined amount of food flows into the metering cylinder 13 through the supply pipe 29. Subsequently, the plunger 26 is moved to its upper limit position, opening the flow inlet 21, and the piston 12 is moved from the right limit position to the left limit position with the cock 31 closed, whereby the predetermined amount of food is sent out from the metering cylinder 13 into the filling nozzle 11. A major portion of the food sent into the filling nozzle 11 is discharged from an opening at the lower end of the nozzle 11 and filled into a container, whereas the food partly adheres to the nozzle 11 and remains therein.

When the supply from the metering cylinder 13 is discontinued, the plunger 26 is lowered, whereby the food remaining in the filling nozzle 11 is forced out from the nozzle 11. At this time, the food forced out comes into contact with the lower end face of the plunger 26, whereas the recess 42 in the food adhesion preventing member 35 provides a reservoir retaining air in the central portion of the lower end face of the plunger 26, so that the food adheres only to the outer peripheral portion of the plunger end face without adhering to the central portion thereof. With the plunger 26 brought to its lower limit position, pressurized air is supplied to the air discharge opening 41 via the air channel 44 and the air chamber 39, whereupon the food adhering to the outer peripheral portion of lower end face of the plunger 26 is blown off with the air discharged from the opening 41.

Various modifications of the plunger will be described next with reference to FIG. 4.

Figure 4:
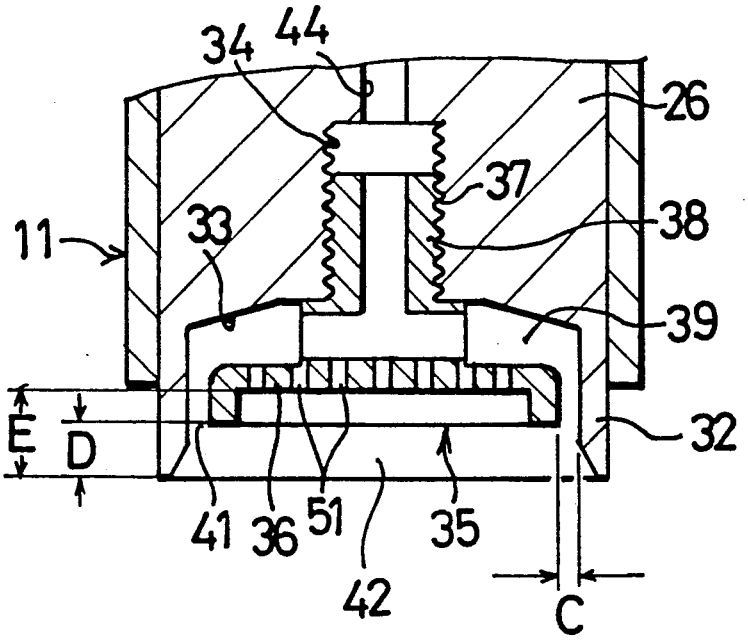
FIG. 4 is a sectional view corresponding to FIG. 2 and showing a modified plunger.

Although FIG. 4 shows only one example of modified plunger, one of the food adhesion preventing members to be described below is selectively used which is shaped suitably for the properties of the food to be handled.

First, the distance D from the lower end of the plunger 26 to the lower end of the preventing member 35 is set to a relatively large value when the solid ingredient incorporated in the food is difficult to cut like meat, or conversely to a relatively small value when the solid ingredient is easy to cut like vegetables, etc. When D is large, the ingredient is less likely to be held in the clearance C. Next, the distance E from the lower end of the plunger 26 to the top of the recess 42 in the preventing member 35 is set to a great value if the ingredient is relatively large, or to a small value when the ingredient is relatively small. The larger the distance E, the higher is the ceiling of the air reservoir provided in the lower end of the plunger 26 and the less is the likelihood of large solid ingredients coming into blocking contact with the ceiling. Lastly, the clearance between the skirt 32 of the plunger 26 and the preventing member 35, i.e., the width C of the air discharge opening 41, is set to a small value when the viscosity of the food is relatively great, or to a great value if the viscosity is relatively low. The smaller the width C, the higher is the pressure of air discharged from the opening 41. When the viscosity of the food is higher, the pressure of air discharged is preferably higher, and vice versa.

Figure 5:
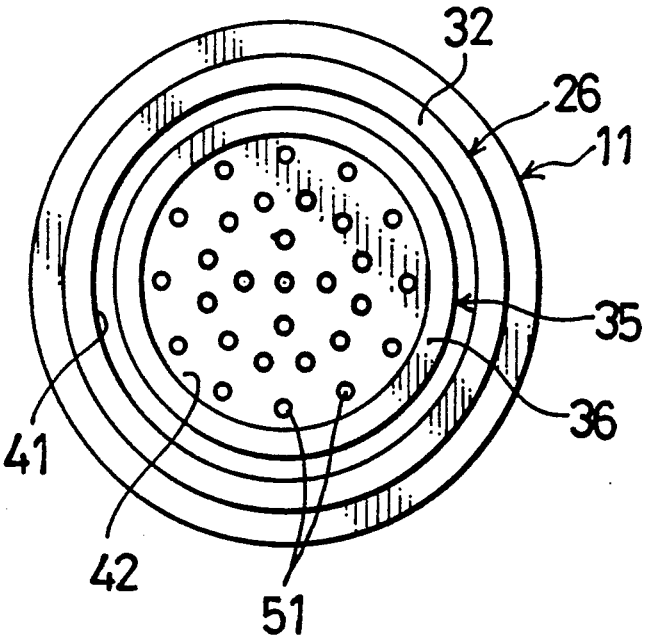
FIG. 5 is a bottom view of FIG. 4.

With reference to FIG. 5 in addition to FIG. 4, the food adhesion preventing member 35 shown has a top wall defining the recess 42 and formed with a plurality of small air ports 51 which are positioned dispersely over the entire area of the top wall. Air can then be discharged not only from the opening 41 but also from the small ports 51. This arrangement is effective for foods having a high viscosity and containing a solid ingredient which is difficult to cut.

Figure 6:
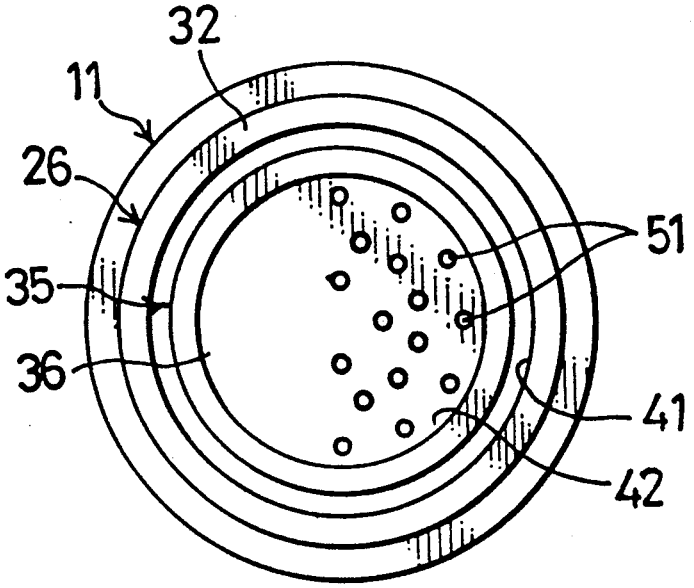
FIG. 6 is a bottom view corresponding to FIG. 2 and showing another modified plunger.

With reference to FIG. 6, small air ports 51 the same as those shown in FIG. 5 are formed only in the right half of the top wall of the preventing member 35 defining the recess 35. This indicates that the small air ports 51 can be formed only in this portion since food is more likely to adhere to the lower end of the plunger 26 toward the right side thereof which is closer to the flow inlet 21 of the filling nozzle 11.

Figure 7:
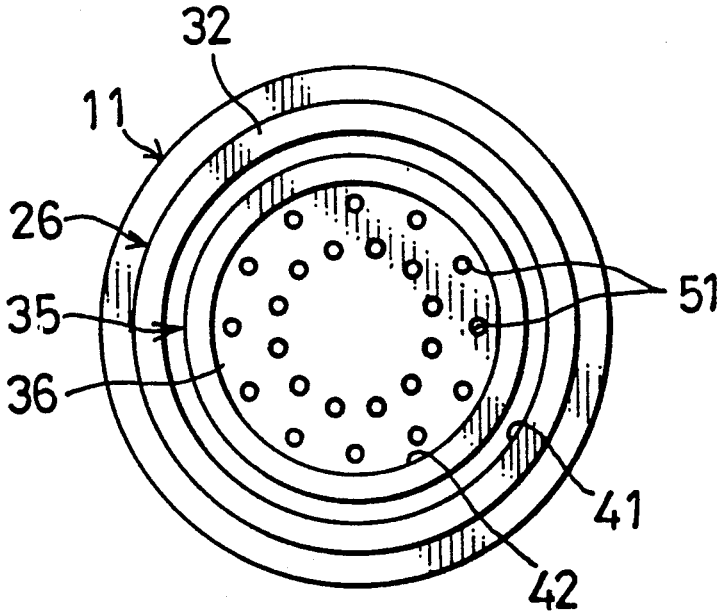
FIG. 7 is a bottom view corresponding to FIG. 5 and showing another modified plunger.

Further with reference to FIG. 7, no small air port 51 is formed in the central portion of the recess-defining top wall of the preventing member 35. This indicates that food is less likely to adhere to this portion.

What is claimed is:

1. A filling apparatus for viscous foods comprising:

a vertical tubular filling nozzle having a flow inlet formed in a tubular wall close to a lower end thereof and a piston-incorporating metering cylinder in communication with the flow inlet, and a plunger accommodated in the filling nozzle so as to open or close the flow inlet, the plunger having a skirt at a lower-end peripheral portion thereof, a food adhesion preventing member accommodated inside the skirt, an air discharge annular clearance formed between the skirt and the preventing member for blowing off adhering food, and a recess formed in a lower face of the preventing member and providing an air reservoir for preventing adhesion of the food.

2. A filling apparatus as defined in claim 1 wherein the plunger has a threaded bore formed in a lower-end central portion thereof, and the food adhesion preventing member comprises a horizontal disk portion including the recess, and a vertical cylinder portion extending upright from the top side of the disk portion centrally thereof, the cylinder portion being externally threaded and screwed in the threaded bore.

3. A filling apparatus as defined in claim 1 wherein a pressurized air chamber communicating with the air discharge clearance is formed inside the skirt above the preventing member, and the preventing member is formed with a multiplicity of air discharge small ports extending vertically therethrough from the air chamber and opened in a top wall defining the recess.

4. A filling apparatus as defined in claim 3 wherein the air discharge small ports are positioned dispersely over the entire area of the recess-defining top wall.

5. A filling apparatus as defined in claim 3 wherein the air discharge small ports are locally positioned in a peripheral portion of the recess-defining top wall.

6. A filling apparatus as defined in claim 3 wherein the air discharge small ports are locally positioned in one side of the recess-defining top wall close to the flow inlet.

* * * * *